United States Patent [19]

Hershberger

[11] 4,451,927

[45] May 29, 1984

[54] SEPARATION CORRECTION METHOD AND APPARATUS FOR PLURAL CHANNEL TRANSMISSION SYSTEM

[75] Inventor: David L. Hershberger, Quincy, Ill.

[73] Assignee: Harris Corporation, Melbourne, Fla.

[21] Appl. No.: 361,572

[22] Filed: Mar. 24, 1982

[51] Int. Cl.[3] ..... H04H 5/00

[52] U.S. Cl. ..... 381/15; 381/16

[58] Field of Search ..... 381/15, 16, 10, 13; 455/295

[56] References Cited

U.S. PATENT DOCUMENTS

| | | | |
|---|---|---|---|
| 3,087,995 | 4/1963 | Hellstrom . | |
| 3,372,350 | 3/1968 | Kawahashi et al. . | |
| 3,528,037 | 9/1970 | Yamazaki . | |
| 4,194,088 | 3/1980 | Streeter . | |
| 4,194,154 | 3/1980 | Kahn . | |
| 4,208,547 | 6/1980 | Simeau | 381/13 X |
| 4,211,978 | 7/1980 | Takahashi | 381/10 |
| 4,225,751 | 9/1980 | Hershberger . | |

OTHER PUBLICATIONS

Comments of Motorola, Inc. filed with the FCC in response to Notice of Proposed Rulemaking–pp. II–3 to II–13.

*Primary Examiner*—R. J. Hickey

*Attorney, Agent, or Firm*—Yount & Tarolli

[57] ABSTRACT

Apparatus is disclosed for use in improving the separation between the individual channels of a plural channel communication system such as a stereo AM radio broadcasting system. The separation corrections are made to the baseband signals. Two sources (14, 16) provide input signals to a matrix circuit (18) which generates sum and difference signals therefrom. A circuit (44) adjusts the phase of the difference signal relative to the sum signal. The circuit (44) includes phase shifting circuits (50, 52) which provide two difference signals phase shifted by ninety degrees relative to one another. The two signals are combined in a signal adder (54). The degree of phase shift provided by the circuit (44) is selectively adjusted by varying the gain of gain circuits (46, 48) included in the paths of the two difference signals. Means (42, 44) are included for varying the gains of the input signals to the difference signal. The gain factors are frequency dependent in some embodiments.

33 Claims, 11 Drawing Figures

WHERE $A=f_1(G1,G2)$
AND $\theta=f_2(G1,G2)$

SEPARATION CORRECTION METHOD AND APPARATUS FOR PLURAL CHANNEL TRANSMISSION SYSTEM

BACKGROUND AND FIELD OF THE INVENTION

The present invention relates to plural channel transmission systems, and more particularly to a circuit for improving the separation between the individual channels of the transmission system.

As applied to plural channel transmission systems, the term "separation" refers to the extent to which the various channels of the transmission system are isolated from one another. Ideally, channel separation is infinite, whereby a signal transmitted through any one channel will not cross over, or "bleed", into other channels to any extent. In practical systems, however, the separation is less than ideal whereby the signals provided on the individual channels will cross over into other channels to some extent.

Designing circuits which optimize channel separation is a continuing challenge to engineers engaged in the design and manufacture of multiple channel systems, such as stereophonic sound recording and reproducing equipment, and stereophonic radio transmitting and receiving equipment. Ordinarily, the entire system is designed from the outset to accommodate plural channels, whereby the design of each element of the system can be selected so as to minimize the effect it has upon separation. In some systems, however, major system components initially designed to carry only a single channel of information are, for reasons of economy, used without substantial modification. These system components may tend to degrade channel separation.

Channel separation problems of this sort are particularly evident in stereophonic AM radio transmission systems. Although stereophonic AM broadcasting is not yet routinely practiced, various proposals have been made to the Federal Communications Commission (FCC) of the United States Government for the adoption of AM stereo transmission regulations. Existing monophonic AM radio stations can be retrofitted to broadcast any of the AM stereo signals being proposed, without replacing the existing transmitter and antenna network. The AM transmitters and their associated antenna networks, however, were not initially designed to accommodate the complexities of the AM stereo signals and can asymmetrically affect different parts of an AM stero signal, thereby degrading the separation between the stereo channels.

SUMMARY OF THE INVENTION

It is an object of the present invention to provide a method and apparatus for improving channel separation in plural channel transmission systems.

It is an additional object of the present invention to provide method and apparatus for correcting stereo separation in AM stereo transmission systems.

It is still another object of the present invention to provide method and apparatus for correcting phase and amplitude asymmetries of the composite signal transmitted by conventional AM transmitters so as to thereby improve the separation between the two stereophically related input signals.

In accordance with the present invention, apparatus is disclosed for providing two signals for application to corresponding inputs of a plural channel transmission system. The apparatus comprises first means for providing two input signals to be communicated over different channels of a plural channel communication system, means responsive to said second signal for providing two modified second signals therefrom, said signals being phase shifted relative to one another by a fixed amount, means for selectively adjusting the relative gains of said two modified second signals, and means for combining the two modified second signals so as to form a combined signal to be communicated over a channel of said communication system in place of said second signal.

In accordance with another aspect of the present invention, apparatus is disclosed for providing a sum signal corresponding to the sum of first and second audio input signals and a difference signal corresponding to the difference between said first and second audio input signals, where the gain of said difference signal is dynamically varying, and processing means responsive to the sum and difference signals for providing a modified difference signal corresponding generally to the difference signal but having a compensation signal combined therewith, said compensation signal corresponding to a selectable gain factor times the sum of said sum and difference signals plus a selectable gain factor times the difference between said sum and difference signals. The apparatus also includes means for providing the sum and modified difference signals to a plural channel transmission system for transmission over independent channels thereof.

In accordance with still another aspect of the present invention, the foregoing apparatus is incorporated in an AM stereo radio broadcasting system.

BRIEF DESCRIPTION OF THE DRAWINGS

The foregoing and other objects and advantages of the present invention will become more readily apparent from the following detailed description as taken in conjunction with the accompanying drawings, wherein.

DETAILED DESCRIPTION

Figure 1:
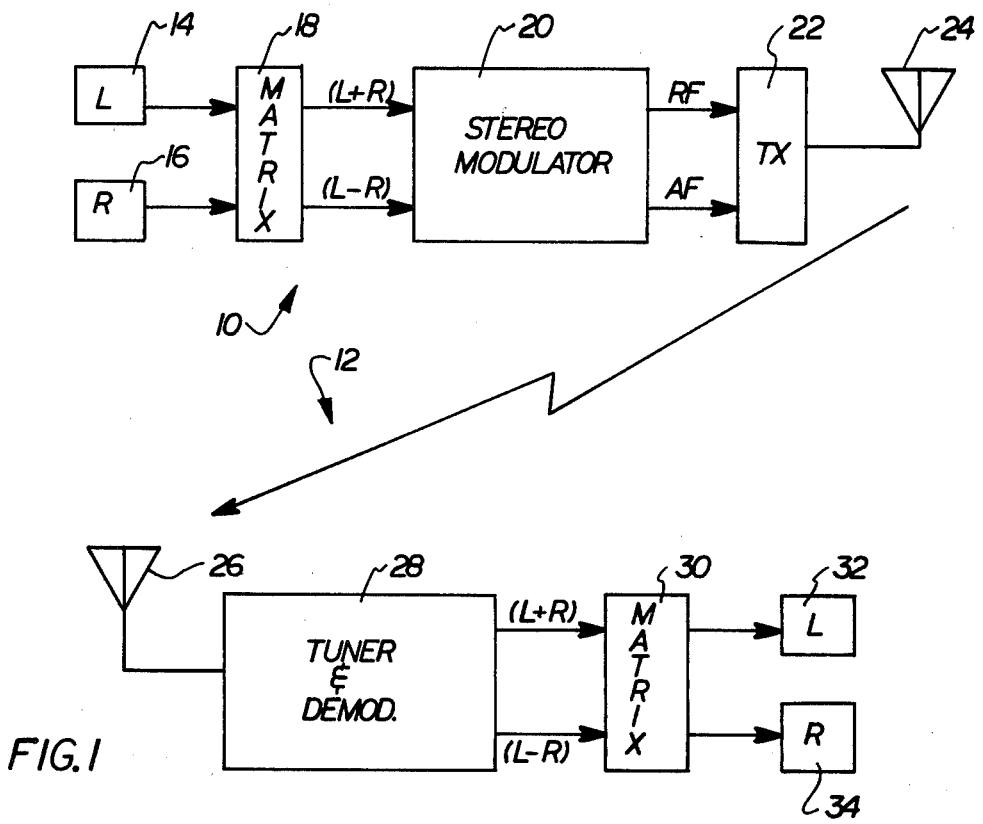
FIG. 1 is a broad block diagram of a conventional AM stereo transmission and reception system.

There are currently five different proposals before the Federal Communications Commission of the U.S. Government of possible forms of stereo systems for the AM radio broadcasting band. Each form may be characterized broadly as shown in FIG. 1. In FIG. 1, an AM stereo transmitter has been denoted at 10 and an AM stereo receiver is denoted at 12. The transmitter 10 includes two audio signal sources 14 and 16 which provide the two stereophonic signals which are to be transmitted to the remote receiver 12. These two signals are usually referred to as the "left" (L) and "right" (R) signals. The L and R signals are directed to a matrix circuit 18 which adds them together to generate a "sum" signal corresponding generally to the sum of the two signals (i.e. to L+R) and subtracts them from one another to generate a "difference" signal corresponding to the difference between the two input signals (i.e. to L−R). The sum and difference signals are applied to a stereo modulator circuit 20 which generates an audio frequency (AF) signal and a radio frequency (RF) signal in response. The AF and RF signals are applied to a conventional AM transmitter 22 which amplifies the RF signal and amplitude modulates it in accordance with the AF signal. The resulting high level modulated RF carrier signal is applied to an antenna network indicated generally at 24 for transmission to the remote receiver 12.

The AF and RF signals are derived from the sum and difference signals in accordance with various rules which differ from one system to another. In general, however, the AF signal corresponds closely to the sum signal whereby the high level modulated RF signal provided by the transmitter 22 is amplitude modulated essentially by the sum signal. The RF signal is of fixed amplitude, but has a modulated phase or frequency. The phase or frequency variations of the RF signal (and thus the phase or frequency variations of the high level RF signal provided by transmitter 22) are related to the difference signal and, in some systems, to the sum signal as well.

At the receiver 12, the modulated RF signal is picked up by antenna 26 and applied to a tuner/demodulator circuit 28. The tuner/demodulator circuit 28 recovers the sum and difference signals from the modulated carrier signal, and applies them to a matrix 30 where they are added to recover the L signal and subtracted to recover the R signal. The L and R signals are then applied to suitable utilization means 32 and 34, which are conventionally audio speakers.

Ideally, the signals which are provided to the utilization means 32 and 34 are identical to the signals generated by the two sources 14 and 16. If this were the case, a signal provided by signal source 14, for example, would arrive at the utilization means 32 only, and would not bleed over into the channel represented by the second utilization means 34. In practical systems, however, some cross talk between the two channels will occur. Thus, if only the left signal source 14 is providing a signal, this signal will appear not only at the left utilization means 32 but also to some extent at the right utilization means 34. Similarly, if an input signal is being provided by the right signal source 16 but not the left, a signal will appear not only at the right utilization means 34, but also to some extent at the left utilization means 32.

It will be noted, for example, that the (L+R) and (L−R) signals must be of equal gain in order for the matrix circuit 30 in the receiver to operate properly. If the two signals are not of the same gain, then the R signal will not cancel from the L channel, and the L signal will not cancel from the R channel. Consequently, poor separation results. In view of this effect, it has been recognized that it is desirable to provide adjustment for the magnitude of the (L−R) portion of the signal in the transmitter. A potentiometer may be provided between the (L−R) output of the matrix circuit 18 and the corresponding input of the stereo modulator 20. The potentiometer will be adjusted so as to equalize the amplitudes of the (L+R) and (L−R) portions of the signal, thereby improving separation.

Cross talk between the two stereophonic channels is, however, also caused by a multiplicity of other factors, including the nonidealities of the transmitter 22 and antenna network 24. The antenna and transmitter will often be conventional monophonic AM broadcasting transmitters and antennas which have been retained in order to conserve the cost of conversion from monophonic to stereophonic service. Conventional monophonic transmitters and antennas have, however, been designed to amplify and transmit signals having signal characteristics which are less complex than typical AM stereo signals.

More particularly, conventional AM transmitters and antenna networks have been designed for use in a system wherein there is no angle modulation of the applied RF signal. The RF input port of the transmitter may therefore have a very narrow pass band, and may exhibit phase and amplitude asymmetries across this pass band. In independent sideband (ISB)-type systems the non-idealities manifest themselves by introducing amplitude and phase shift to the L signal relative to the R signal. In other types of systems the nonidealities generally manifest themselves by introducing amplitude and phase shift to the "difference signal" part of the signal, (which is carried principally, if not exclusively, in the phase variations of the RF carrier signal) relative to the "sum signal" part.

The same separation correction circuitry may be used n both ISB and non-ISB systems. The effect of the various corrections, however, is different for the two types of systems. For simplicity of description and to prevent confusion, the description of FIGS. 4–11 which follows will deal specifically with non-ISB type systems. A discussion of the application of the separation correctors to ISB-type systems is provided following the description of FIG. 11.

The effect of the nonideal nature of the transmitter and antenna network is to render the separation of the system different for the left channel than for the right channel. If the (L−R) gain is adjusted so that a signal appearing on the left channel will not bleed over into the right channel, a signal appearing on the right channel may nonetheless bleed over into the left channel to some extent. When the separation in the right channel is corrected, however, separation in the left channel may be degraded. This phenomena cannot be compensated for adequately by merely adjusting the amplitude of the (L−R) portion of the signal. It has been recognized in the prior art that stereo separation in a non-ISB type system can be improved by a slight imbalance of the L and R amplitudes in the (L−R) signal relative to the (L+R) signal.

Figure 2:
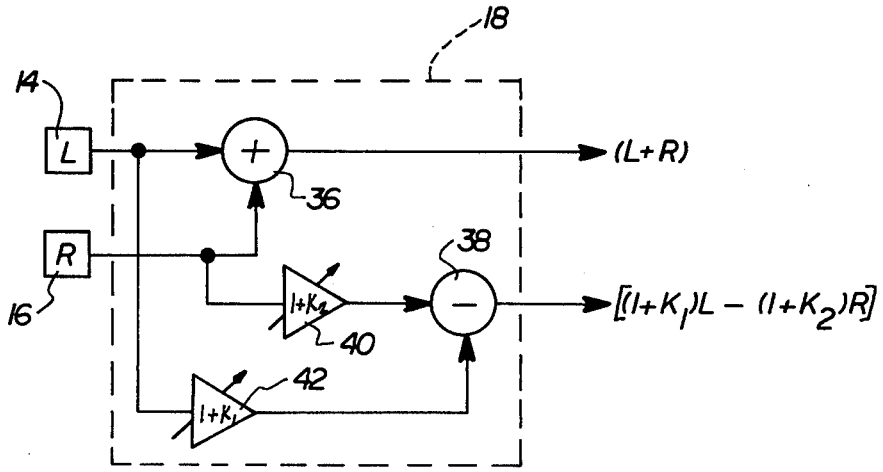
FIG. 2 is a block diagram of a matrix circuit including adjustments enabling correction of some transmission system asymmetries.

FIG. 2 illustrates one of the ways in which the matrix circuit 18 may be designed so as to permit independent adjustment of the left and right channel separation in a non-ISB type system. In FIG. 2, the matrix circuit 18 is shown as including conventional adder and subtractor circuits 36 and 38 to create the sum and difference signals. The adder circuit 36 has two inputs, each connected to one of the outputs of the L and R signal sources 14 and 16, and provides an output signal corresponding to the sum of the two input signals. The subtractor circuit 38 also has two inputs respectively connected to the output of the L and R signal sources 14 and 16. In this case, however, variable gain circuits 40 and 42 are connected in series with each of the input lines.

Variable gain circuit 40 is connected between the output of the right signal source 16 and one input of the subtractor circuit 38. Variable gain circuit 42 is connected between the output of the left signal source 14 and the other input of the signal subtractor circuit 38. Each variable gain circuit has a manually controllable gain factor which is characterized in FIG. 2 as equal to (1+K). The gain of each circuit can vary between values, for example, of 0.5 and 1.5 (i.e. the K term of each circuit may be considered to vary between −0.5 and +0.5). The output of the signal subtractor circuit 38 therefore has the form $[(1+K_1)L-(1+K_2)R]$. The contributions of the L and R terms can be independently varied by adjusting the gains of the two circuits 40 and 42.

The circuit is adjusted by first applying a signal to the left channel only, and manually adjusting the gain of variable gain circuit 42 so that the magnitude of the signal appearing on the right output of a subsequent receiver is minimized. Thereafter a signal is applied to the right channel only and the gain of the variable gain circuit 40 is manually adjusting until the signal appearing on the left channel is minimized.

Figure 3:
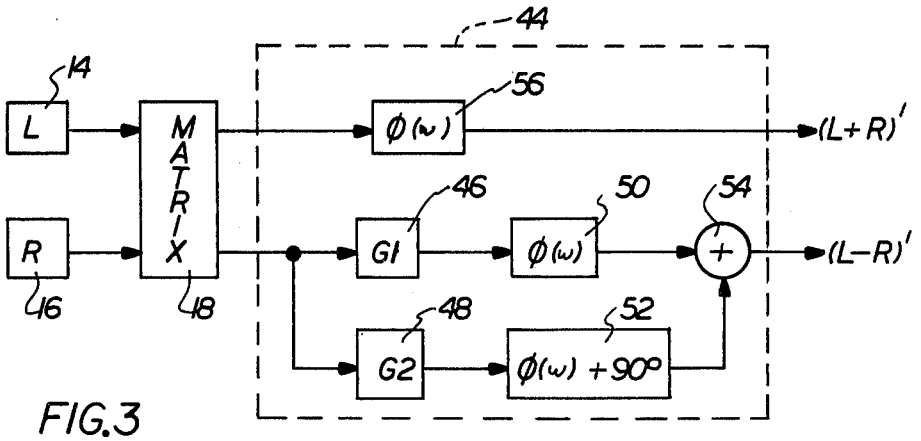
FIG. 3 is a block diagram of one embodiment of the separation corrector in accordance with the teachings of the present invention.

The separation corrector shown in FIG. 2 provides correction for phase shift-induced errors in the downstream RF circuitry, such as those caused by the wrong carrier phase or phase asymmetry of the RF bandpass filters. This separation corrector cannot correct for separation loss introduced by amplitude asymmetry of the RF passband of the transmitter and antenna network, however. A general form of a separation corrector for correcting this type of error is shown in FIG. 3. In FIG. 3, the additional separation correction circuit 44 is shown connected in series with the output of the matrix circuit 18.

The circuit 44 is shown in FIG. 3 as including two gain adjusting circuits 46 and 48, each of which has the difference signal (L−R) applied to its input. Each gain adjusting circuit introduces a manually variable gain factor to its respective input signal. The gain value may be positive or negative. The gain adjusting circuits provide their gain adjusted output signals to respective phase shifter circuits 50 and 52. The phasing circuits 50 and 52 are designed to introduce phase shift in their respective input signals such that each frequency of the signal at the output of phase shifter circuit 52 is phase shifted by 90° with respect to the same frequency signal at the output of the phase shifter 50.

In the FIG. 3 embodiment this is accomplished by phase shifting the output of gain circuit 46 by o, and phase shifting the output of gain circuit 48 by o+90°. It would in theory be simpler to merely phase shift the output of gain circuit 48 by 90° and the output of gain circuit 46 by nothing. In practice, however, it is difficult to construct and align a circuit to provide precisely 90° phase shift over a range of frequencies, whereas it is relatively easy to design two circuits which provide a phase shift of 90° relative to each other over a range of frequencies. This approach is therefore followed in FIG. 3 and the Figures which follow.

The outputs of the two phase shifter circuits 50 and 52 are provided to an adder circuit 54 which combines them to produce a modified difference signal. The output of adder circuit 54 corresponds generally to the difference signal provided by matrix circuit 18, but has an amplitude and phase determined by the gain terms G1 and G2 introduced by gain circuits 46 and 48.

Figure 4:
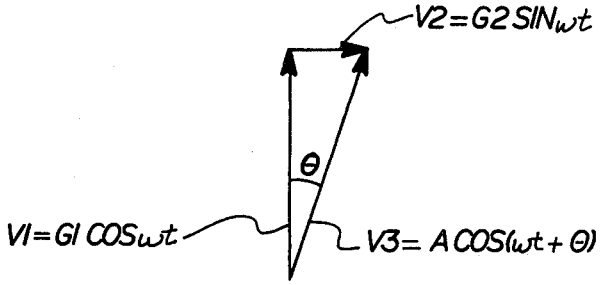
FIG. 4 is a vector diagram useful in understanding the operation of the FIG. 3 apparatus.

The operation of the FIG. 3 circuitry may perhaps be better understood with reference to the vector diagram of FIG. 4. In this Figure the difference signal is treated as a single tone having a fixed amplitude and an angular frequency of w. The vector V1 represents the signal provided at the output of the phase shifter circuit 50, whereas the vector V2 represents the signal at the output of the phase shifter 52. These two vectors are oriented perpendicular to one another in FIG. 4 since the signals are orthogonal to one another in phase. The vector sum of the two vectors 51 and 52 (in other words the vector V3 of FIG. 4) represents the additive sum of the signals provided by the circuits 46 and 48 and thus corresponds to the output of adder circuit 54.

It will be noted that both the phase angle 0 between the vector V3 and the vector V1 and the amplitude A of the vector V3 are functionally dependent upon the two gain terms G1 and G2 introduced by gain circiuts 46 and 48. Consequently, the amplitude and phase angle of the sum vector V3 can be controlled by controlling these values. In practical terms, this means that the phase and amplitude of the modified (L−R) signal appearing at the output of the adder circuit 54 can be controlled relative to the phase and amplitude of the signal at the output of phase shifter 50 by controlling the two gain values G1 and G2.

The (L+R) output of the matrix circuit 18 is directed to a third phase shifter circuit 56 which introduces a phase shift having a magnitude equal to the phase shift experienced by the (L−R) signal in the phase shifter 50. Consequently, when the gain term G2 has the value of zero, the (L−R) signal at the output of adder circuit 54 will be phase synchronized with the modified (L+R) signal provided at the output of phase shifter circuit 56. The phase angle of the (L−R) signal relative to the (L+R) signal, however, can be advanced or delayed relative to the (L+R) signal by changing the magnitude and sign of the G1 and G2 values. By adjusting these two values, then, a phase shift can be introduced between the two signals which compensates for amplitude asymmetry in the RF band pass of the modulator, transmitter and antenna circuits which follow. This has the effect of improving the separation between the L and the R signals as subsequently reproduced at a remote radio receiver.

Figure 5:
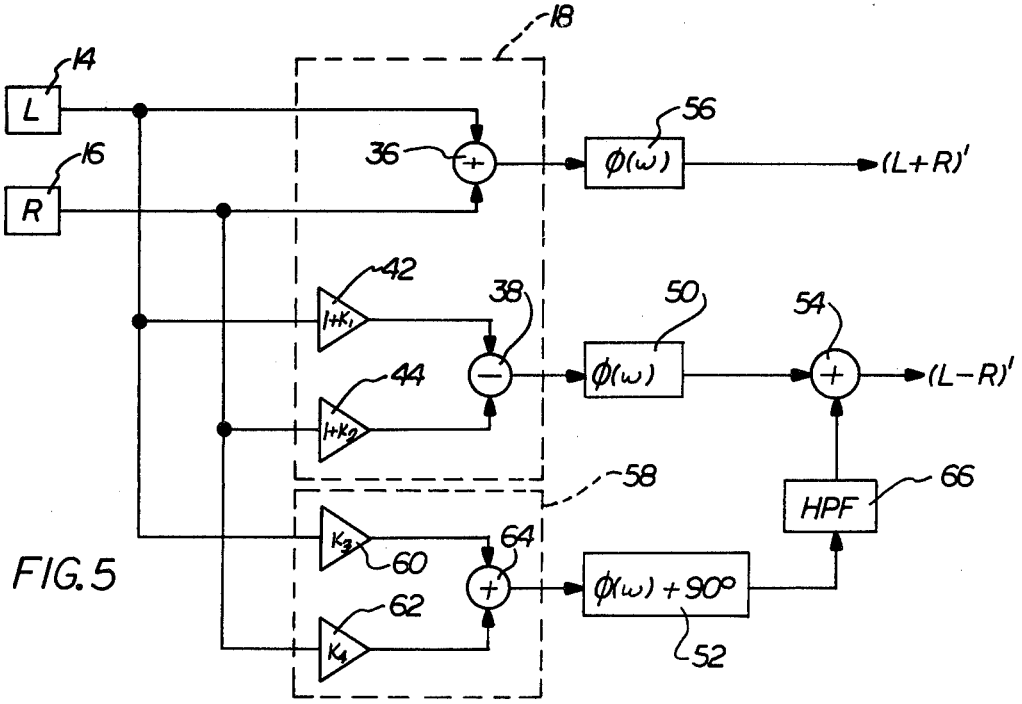
FIG. 5 is a block diagram of a second embodiment of the separation corrector in accordance with the teachings of the present invention.

FIG. 5 illustrates a second embodiment of circuitry for implementing the FIG. 3 separation correction. As in the FIG. 3 embodiment, the FIG. 5 embodiment includes a matrix circuit 18, three phase shifter circuits 50, 52 and 56 and an adder circuit 54. The output of the phase shifter circuit 52 is, however, connected to the adder circuit 54 through a high pass filter 66 which eliminates low frequency signals therefrom. The high pass filter 66 is included since it has been found that the (L−R) phase shifts corrected by this circuitry occur principally at high frequencies in the audio signals.

The functions performed by gain circuits 46 and 48 of FIG. 3 are performed differently in FIG. 5. The function performed by variable gain circuit 46 of FIG. 3 is performed in the FIG. 5 embodiment by the two variable gain circuits 42 and 44 associated with the matrix circuit 18. The variable gain function accomplished in FIG. 3 by the circuit 48, on the other hand, is performed in FIG. 5 by a circuit 58 which provides gain adjustments for the L and R channels separately, rather than a single gain adjustment for the (L−R) signal. More particularly, the circuit 58 includes two manually variable gain circuits 60 and 62 which are respectively connected to the outputs of the L and R signal sources 14 and 16. The outputs of the two variable gain circuits 60 and 62 are connected to respective inputs of an adder circuit 64. The output of the adder circuit 64 is the additive sum of these two signals, and can be represented as ($K_3L+K_4R$) where the variables $K_3$ and $K_4$ may assume values between −0.5 and +0.5, for example. The output of the adder circuit 64 is directed to the phase shifter circuit 52.

The circuit 58 is preferred over the single gain adjusting circuits 48 of FIG. 3 because it permits independent adjustment of the L and R contributions to the signal which is phase shifted by phase shifter 52. The adjustment of gain adjustment circuits 60 and 62 is simplified over the adjustment of the circuit 48 of FIG. 3, since each of the two gain adjustment circuits controls the contribution of only a single signal.

Figure 6:
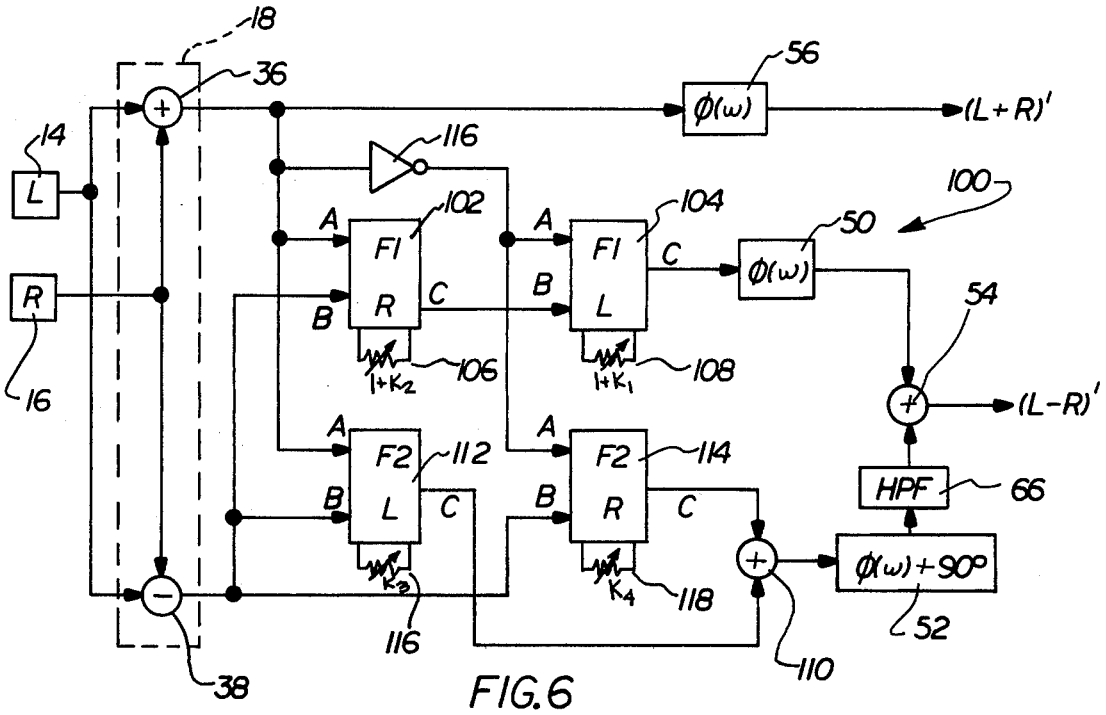
FIG. 6 is a block diagram of a third embodiment of the separation corrector in accordance with the teachings of the present invention.

FIG. 6 illustrates a preferred embodiment of a stereo separation corrector in accordance with the teachings of the present invention. As in the previous embodiments, the outputs of the left and right signal sources 14 and 16 are provided to corresponding inputs of a matrix circuit 18. The matrix circuit 18 is shown as having a conventional form, including adder and subtractor circuits 36 and 38 respectively but lacking the gain adjustment circuits (identified by reference numerals 42 and 44 in FIG. 2) included in preceding Figures. The separation corrector, generally indicated at 100, is connected to the output of the signal adder 36 and signal subtractor 38, and utilizes these two signals alone in generating the modified (L+R) and (L−R) signals. The separation corrector 100 includes the three phase shifter circuits 50, 52 and 56 as well as the high pass filter 66 and adder 54 of the FIG. 5 embodiment, but includes different circuitry for providing the two gain adjusted (L−R) signals which are phase-shifted, filtered and added thereby.

The input to the phase shifter 50 is derived from circuitry including two functional blocks 102 and 104 having substantially the same form. Each of these functional blocks has a transfer characteristic F1 such that the output signal C is related to the two input signals A and B by the following expression:

$$F1=C=B-(A-B)K \quad (1)$$

For functional block 102, the A input is (L+R) and the B input is (L−R), whereby the output C is equal to:

$$C=L-R-2K_1R \quad (2)$$

For functional block 104, which has the same transfer characteristic as functional block 102, the A input is derived from an inverter 116 having its input connected to the (L+R) output of matrix 18, whereby it has the form (−L−R). The B input, on the other hand, is connected to the output of functional block 102 and is thus described by equation (2), above . By plugging these values into equation (1), we find that the C output of functional block 104 is equal to:

$$C=L-R+2K_1R+K_2L+K_1K_2R \quad (3)$$

This is similar in form to the signal provided to the phase shifter block 50 in preceding embodiments. The functional blocks 102 and 104 include means 106 and 108 respectively for manually adjusting the values of the terms $K_1$ and $K_2$.

The input signal for the phase shifter block 52, on the other hand, is derived from an adder circuit 110 which adds together the outputs of two other functional blocks 112 and 114. Functional blocks 112 and 114 have the same transfer characteristics F2, where the transfer characteristic F2 is different than the transfer characteristic F1 of functional block 102 and 104. More particularly, the output C of each of these blocks may be characterized, in terms of their inputs A and B, as:

$$C=\frac{(A+B)K}{2} \quad (4)$$

where K is variable between +0.5 and −0.5. Since the functional block 112 has the (L+R) signal applied to its A input and the (L−R) signal applied to its B input, the output thereof is:

$$C=K_3L \quad (5)$$

The output of functional block 114, on the other hand, is $$C=K_4R \quad (6)$$

since its A input is derived from the inverter 116 which inverts the (L+R) signal to provide (−L−R), whereas its B input is connected to the (L−R) output of the matrix circuit. When the outputs of the two functional blocks 112 and 114 are combined in the adder circuit 110, an output signal is formed which is equal to $K_3L+K_4R$, which is the same signal applied to the phase shifter block 52 in the FIG. 5 embodiment.

In view of the foregoing, it is apparent that the circuitry of FIG. 6 operates to provide substantially the same adjustments as are provided by the circuitry of FIG. 5, presuming that the transfer characteristics of functional blocks 102, 104, 112 and 114 are as given.

Figure 7:
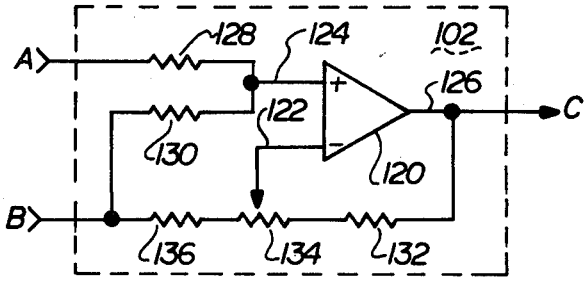
FIG. 7 is a circuit schematic representing one form which the "F1" functional block of FIG. 6 may take.

FIG. 7 illustrates one embodiment of the functional block 102 of FIG. 6, it being understood that the functional block 104 may have substantially the same form. As shown in FIG. 7, the functional block 102 includes an operational amplifier 120 having inverting and noninverting inputs 122 and 124 respectively and an output 126. The operational amplifier 120 is characterized by a high gain, a high input impedance on the two input lines 122 and 124, and a low output impedance on the output line 126. The noninverting input 124 is connected to each of two input lines A and B through respective resistors 128 and 130. These resistors have equal resistance values, whereby the voltage at the junction there-between is equal to the average of the two signals (i.e. to (A+B)/2).

The operational amplifier is connected in a negative feedback arrangement, with the output line 126 being connected to the B input source through three series resistors 132, 134 and 136, where resistors 132 and 136 have equal, fixed values and resistor 134 is a potentiometer having its wiper arm connected to the inverting input 122 of operational amplifier 120. The operational amplifier 120 provides an output signal which is such that the signal appearing on the inverting input line 122 follows the signal appearing on the noninverting input line 124. Using conventional circuit analysis techniques, it can be shown that the output signal appearing on the output line 126 is expressed by equation (1), above, where the value of the term K is set by the setting of potentiometer 134. When the potentiometer is centered, K is equal to zero.

Figure 8:
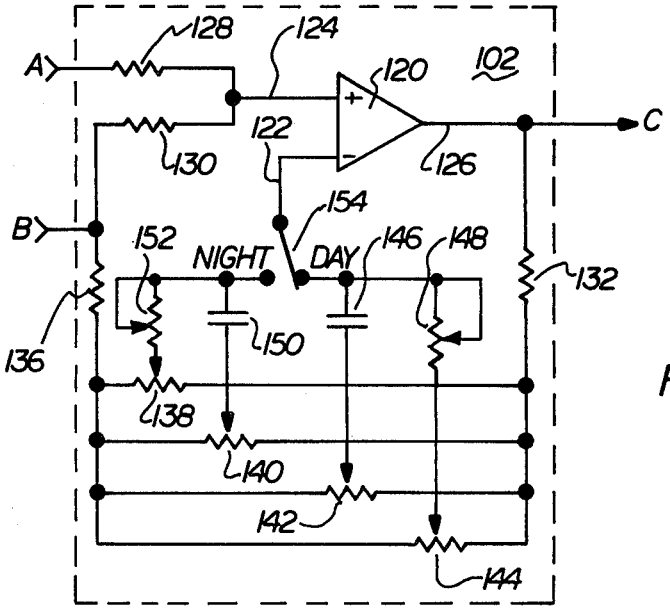
FIG. 8 is a circuit diagram representing a second form which the "F1" functional block of FIG. 6 may take.

FIG. 8 is circuit schematic of a second, and presently preferred embodiment of the functional block 102. The functional block 102 of FIG. 8 is substantially similar to that of FIG. 7, except that the potentiometer 134 has been replaced by four potentiometers 138, 140, 142 and 144 which are connected in parallel with one another. The wiper arms of the potentiometers 142 and 144 are connected together through a series circuit including a capacitor 146 and a potentiometer 148. The wiper arm of potentiometer 148 is shorted to one of its resistor end terminals, whereby the resistance value of the potentiometer may be varied by changing the setting of the wiper arm. The junction between the capacitor 146 and potentiometer 148 is connected to the inverting input of the operational amplifier 120 through a single-pole, double-throw (SPDT) switch 154 having its toggle arm connected to the inverting input line 122 and one of its contacts connected to the junction between potentiometer 148 and capacitor 146.

Adjustment of the three potentiometers 142, 144 and 148 establishes the value of the K term in equation (1), above. In this case, however, the inclusion of the capacitor 146 adds an element of frequency dependency. When potentiometer 148 is set to a zero resistance value, the inverting input line 122 is effectively shorted to the wiper arm of potentiometer 144 and the operation of the circuit is substantially as described above with respect to FIG. 7. As the setting of the potentiometer 148 is changed to increase its resistance value, the influence of the setting of the potentiometer 142 increases, being more pronounced at higher frequencies due to the frequency dependency of the capacitor 146. Since the effect of the setting of potentiometer 142 is greater at higher frequencies, this potentiometer establishes a K value at high frequencies. The setting of potentiometer 144 sets the K value at lower frequencies. The setting of the potentiometer 148, on the other hand, establishes the "crossover" point between the higher and lower frequency domains. Thus, the setting of the three potentiometers enables the setting of an appropriate frequency dependent characteristic for the K value used in equation (1).

The day and night transmission characteristics of a broadcasting station may vary due to changes in the configuration of the station. At night a broadcasting station will often use a different antenna pattern and/or power level. A different transmitter may even be used. It is therefore desirable to include separate setting devices for establishing different separation corrections under day and night conditions. Potentiometers 138, 140 and 152 are included for this purpose. In the embodiment shown in FIG. 8 the potentiometers 142, 144 and 148 establish the "day" settings whereas the potentiometers 138, 140 and 152 establish the "night" setting.

The wiper arms of potentiometers 138 and 140 are connected together through a series circuit including potentiometer 152 and capacitor 150 where the wiper arm of potentiometer 152 is again connected to one resistor end terminal thereof so as to provide a manually variable resistor. The junction point between the potentiometer 152 and capacitor 150 is connected to the second contact of switch 154. The switch 154 is used to connect one of the two groups of potentiometers into the circuits. When the switch is in the position shown, the inverting input of amplifier 120 is connected to the network including potentiometers 142, 144 and 148. When the switch is in its other position, the inverting input 122 is instead connected to the network including potentiometers 138, 140 and 156. The settings of the potentiometers 138, 140 and 152 then establish the "K" value of equation (1) rather than potentiometers 142, 144, and 148.

Figure 9:
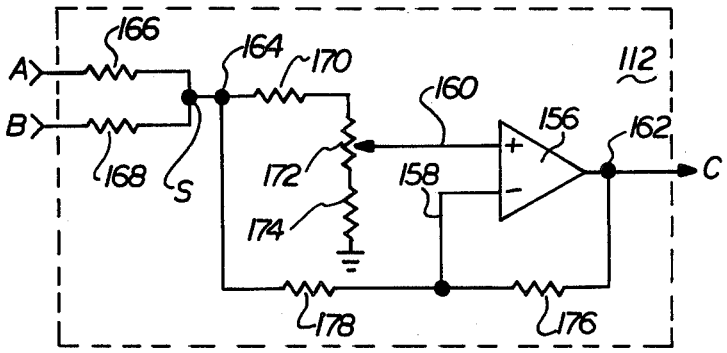
FIG. 9 is a circuit schematic representing one form which the the "F2" functional block of FIG. 6 may take.

FIG. 9 is a detailed schematic of one form which the functional block 112 of FIG. 6 may take, it being understood that functional block 114 may be substantially similar. As shown in FIG. 9, the functional block 112 includes an operational amplifier 156 having inverting and noninverting inputs 158 and 160 and an output line 162. The A and B inputs into the functional block 112 are both connected to a common junction 164 through respective resistors 166 and 168. Resistors 166 and 168 have equal values whereby the signal S appearing at the junction point 164 is proportional to the sum of the two signals. If it is assumed that everything else connected to this node is of relatively high impedance compared to the resistance of resistors 166 and 168, then S is equal to (A+B)/2. The junction point 164 is connected to ground through a series circuit including resistor 170, potentiometer 172, and resistor 174. The wiper arm of potentiometer 172 is connected to the noninverting input 160 of the operational amplifier 156. The resistors 170 and 174 are of equal value whereby the signal appearing at the wiper arm is one half of the signal at junction point 164 when the wiper arm is centered on the potentiometer 172. Consequently, when the wiper arm is centered the signal appearing at the noninverting input 160 of amplifier 156 is substantially equal to S/2.

The operational amplifier 156 is connected in a negative feedback arrangement with a resistor 176 being connected between the output terminal 162 and the inverting input 158 thereof. A resistor 178, having a resistance value equal to the resistance value of resistor 176, is connected between the inverting input terminal 158 and the common node 164. The operational amplifier 156 establishes an output signal having a form such that the signal appearing on the inverting input terminal 158 follows the signal on the noninverting input terminal 160. The output signal is therefore such that the signal appearing on the inverting input terminal 158 is equal to S/2 when the potentiometer 172 is centered. Since resistors 176 and 178 are equal, it follows that the signal on the output terminal 162 is zero when the potentiometer 172 is centered. When the wiper arm of the potentiometer 172 is moved slightly to one side of the center setting, however, an output signal appears on the output line 162 which is equal to K(A+B) where K has a magnitude and polarity depending upon the magnitude and direction of the displacement of the wiper arm of potentiometer 172 from its central setting. The circuit of FIG. 9 therefore provides the transfer characteristic described by equation (4) above.

Figure 10:
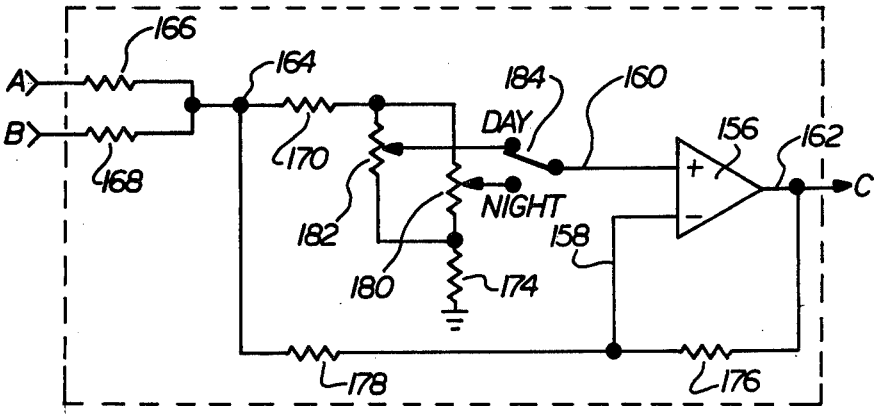
FIG. 10 is a circuit schematic representing a second form which the "F2" functional block of FIG. 6 may take.

FIG. 10 is a circuit diagram of a second and presently preferred embodiment of a functional block 112. This circuit is substantially similar to the one shown in FIG. 9, but has been modified slightly to permit selection of one of two different adjustments for day and night broadcast conditions. In the circuit of FIG. 10 the potentiometer 172 has been replaced by two potentiometers 180 and 182 connected in parallel with one another, and having their wiper arms connected to corresponding contacts of a single-pole, double-throw switch 184. The toggle arm of the switch 184 is connected to the noninverting input line 160 of the operational amplifier 156, whereby the noninverting input line 160 may be connected to either the wiper arm of potentiometer 180 or the wiper arm of potentiometer 182. One of these potentiometers will be used to establish a "day" separation setting whereas the other will be used to establish a "night" separation setting.

The preferred procedure for calibrating the various adjustments included in the circuitry of FIGS. 6, 8, and 10, is as follows. A modulation monitor (not shown, but similar to the reciver 12 of FIG. 1) is used in this procedure. The monitor is designed to receive and demodulate the signals transmitted by the transmitter and antenna network. Initially, the various settings associated with the separation corrector are adjusted so that all "K" terms are zero. All normal adjustments of the transmitter are then made, ignoring those of the separation corrector. A low frequency tone (for example 600 hz.) is then applied to one channel of the transmitter, and the output of the opposite channel of the modulation monitor is analyzed to determine the extent which the tone is bleeding over into that channel. The 600 hz tone may be applied, for example, to the "left" input of the transmitter, with the right input being grounded. In this case the "right" output of the modulation monitor is examined to determine the extent to which the 600 hz. tone is crossing over into the right channel. Functional block 104 is then adjusted to minimize crossover. The control adjusted corresponds with potentiometer 144 of FIG. 8 since it is primarily this control which sets the K value of the functional block at low frequencies. The same 600 hz. tone is then applied to the right input of the transmittor, the left input is grounded, and the analysis equipment is moved to the left output of the modulation monitor. The same adjustment of the functional block 102 is then adjusted to minimize signal bleed from the right channel to the left.

After the low frequency adjustment has been thus accomplished, a high frequency tone, for example 10 khz., is applied to the left input of the transmitter and the right output of the modulation monitor is again examined. Adjustments of functional blocks 104 and 112 are then carried out to minimize this cross over. Adjustment of functional block 104 is accomplished by varying the setting of potentiometer 142 of FIG. 8, since this control setting predominantly establishes the K value of the circuit at high frequencies. The functional block 112, on the other hand, is adjusted by varying the position of potentiometer 182. After these adjustments, the high frequency signal source is applied to the right input to the transmitter, and the left output of the modulation monitor is examined. The corresponding adjustments of functional blocks 102 and 114 are changed to minimize cross talk at this frequency.

Finally, mid-range frequencies are corrected. First a mid-range tone, for example 1 to 2 khz., is applied to the left input of the transmitter, and the right output of the modulation monitor is analyzed. The frequency cross over adjustment of functional block 104 is then adjusted by adjusting the position of the potentiometer 148 of Figure 8 so as to minimize residual cross talk. This same procedure is accomplished for the right channel, after which all adjustments for day broadcasting conditions had been completed. The same procedure would be carried out under night broadcasting conditions, with the switches such as switch 154 of FIG. 8 and switch 184 of FIG. 10 in their alternate positions, however.

Figure 11:
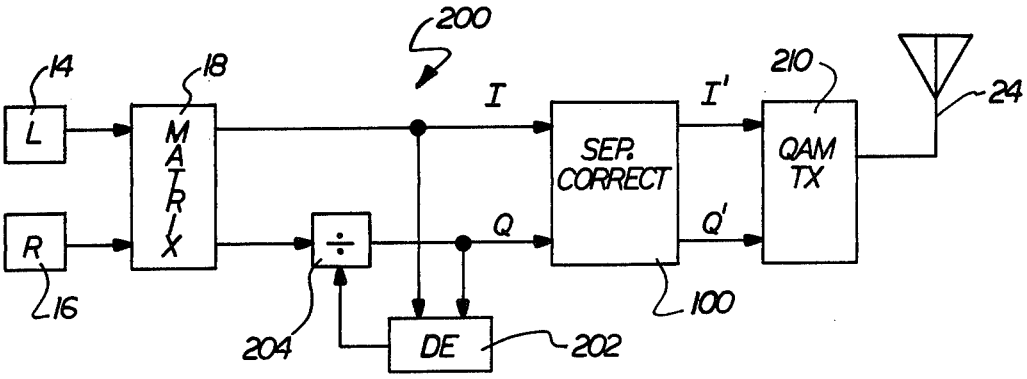
FIG. 11 is a block diagram illustrating the location in which the separation corrector in accordance with the teachings of the present invention may be placed in one particular type of AM stereo system.

The invention has thus far been described with respect to use in modifying the sum (L+R) and a difference (L−R) signals in an AM stereo system. In some systems, such as the V-CPM system proposed by Harris Corporation, it may be desirable to modify baseband signals other than the sum and difference signals, per se. The V-CPM system is described in the U.S. patent to Hershberger, U.S. Pat. No. 4,225,751. In a V-CPM transmitter, one simplified schematic of which is shown in FIG. 11, the gain of the difference signal is dynamically varied. The L and R signal sources are provided to a matrix circuit 18 which provides sum and difference signals at its output. The difference signal is then dynamically gain-adjusted by a circuit 200 which includes a distortion estimator 202 and an analog divider circuit 204.

Analog divider 204 has its "numerator" input connected to the (L−R) output of matrix circuit 18 and its "denominator" input connected to the output of distortion estimator 202. The distortion estimator has two inputs, one connected to the (L−R) output of matrix circuit 18 and the other connected to the output of analog divider circuit 204. As described generally in U.S. Pat. No. 4,225,751, the distortion estimator 202 dynamically adjusts the level of the gain control signal applied to the "denominator" input of analog divider circuit 204 in accordance with a continuously calculated estimation of the level of distortion which the gain-adjusted (L−R) signal will introduce to a conventional "envelope-detector" type monophonic receiver responding to the signal broadcast by the station.

The circuitry will normally also include some means for modulating a pilot signal in accordance with the variations in gain of the difference signal, and for adding this pilot signal into the different channel. For simplicity of illustration this pilot signal circuitry is not shown in FIG. 11.

In the illustrated transmitter the sum and gain-adjusted difference signals are provided to the inputs of a conventional quadrature AM transmitter 210 having in-phase (I) and quadrature-phase (Q) input terminals. The transmitter 210 will usually include a conventional monophonic AM transmitter and antenna network adapted, however, to broadcast a quadrature AM signal. The transmitter amplitude modulates a carrier signal with the I input signal, and double-sideband/suppressed-carrier modulates a quadrature phased carrier signal with the Q input signal. The transmitted signal is the sum of the two modulated carrier signals.

In accordance with the present invention, the separation corrector 100, substantially as described above with respect to FIG. 6, is inserted immediately prior to the I and Q inputs of the QAM transmitter 210.

In the V-CPM transmitter shown in FIG. 11, the separation corrector of FIG. 6 is not placed immediately following the matrix circuit 18, since in this event the (L−R) gain adjustment circuit 204 would dynamically vary not only the gain of the (L−R) signal, per se, but also the separation corrections introduced thereto by the separation corrector. The extent of separation correction would therefore dynamically vary in accordance with the gain adjustment of the (L−R) signal. The separation corrector could be modified to take this into account by including circuitry therein for dynamically adjusting the gain of the separation corrections in accordance with the signal provided at the output of the distortion estimator 202, however this introduces additional complexity into the circuit. It is therefore presently preferred that the separation corrector be located immediately prior to the I and Q inputs of the QAM transmittor 210, whereby the two input signals applied thereto are the (L+R) signal and the gain adjusted (L−R) signal. Although the signals then applied to the inputs of the separation corrector are not, strictly speaking, the same as described above, the operation and effect of the separation corrector is essentially the same.

FIGS. 2–11 have thus far been described with reference to use of the separation corrector in a non-ISB system, such as a quadrature-AM system, modified quadrature-AM system, AM-FM or AM-PM system. The separation corrector can also be used, without change in circuitry, in an ISB-type system. In most ISB systems the L and R signal are each predominantly carried by a corresponding sideband of the composite modulated RF signal. Asymmetry across the RF passband of the transmitter and antenna network therefore tends to distort the amplitude and phase of the L and R signals relative to one another. This does not represent a loss in separation between the L and R signals, but does represent a loss in separation between the sum and difference signals.

To adjust the separation corrector in an ISB-type system, the same input signal is first applied to both the L and R inputs. The corrector is then adjusted so that the L−R signal at the receiver, which should then be zero, is minimized. Next, either the L or R input signal is phase shifted so that the two applied input signals are 180° phase displaced. The corrector is then adjusted so that the L+R signal is minimized at the receiver, since the L+R signal should then be zero. Where, as in the FIG. 6 embodiment, the corrector includes separation controls which are each effective in one of two or more frequency ranges, the ranges will be adjusted separately by application of single tones in each range as discussed previously.

The FIG. 11 transmitter will transmit pure ISB if the divider 204 and distortion estimater 202 are deleted and phase shifters such as phase shifters 50 and 52 of FIG. 3 are inserted into the I and Q lines, respectively. The phase shifters could instead be inserted into the I′ and Q′ lines, however, with similar effect. In each case the separation corrector will operate as described above, although the type of asymmetry correction controlled by each potentiometer of the separation corrector will depend upon where in the ISB system the separation corrector is connected.

Although the invention has been described with respect to a preferred embodiment, it will be appreciated if various rearrangements and alterations of parts may be made without departing from the spirit and scope of the present invention, as defined in the appended claims.

What is claimed:

1. Apparatus comprising means for providing first and second signals to be communicated over different channels of a plural channel communication system, means responsive to said second signal for providing two modified second signals therefrom, said signals being phase shifted relative to one another by a fixed amount, means for selectively adjusting the relative gains of said two modified second signals, means for combining said two modified second signals so as to provide a combined signal to be communicated over a channel of said plural channel communication system in place of said second signal.

2. Apparatus as set forth in claim 1, wherein said means for providing first and second signals comprises means responsive to third and fourth signals for providing a said first signal which is substantially equal to the sum of said third and fourth signals and a said second signal which is substantially equal to the difference between signals proportional to said third and fourth signals.

3. Apparatus as set forth in claim 2, wherein said means responsive to third and fourth signals includes means for providing a selectively gain adjusted third signal, means for providing a selectively gain adjusted fourth signal, and means for subtracting said gain adjusted fourth signal from said gain adjusted third signal so as to thereby provide a difference signal representing said second signal.

4. Apparatus as set forth in claim 1, wherein said means responsive to said second signal for providing two modified second signals therefrom comprises first and second phase shifter means each responsive to said second signal for providing respective phase shifted second signals, wherein at least a selected range of the frequencies in one of said phase shifted second signals are phase shifted by a first amount and at least a selected range of the frequencies in the other of said phase shifted second signals are phase shifted by said first amount plus ninety degrees, whereby said respective phase shifted second signals are phase shifted by ninety degrees relative to one another.

5. Apparatus as set forth in claim 4, wherein means are also included for phase shifting at least a selected range of the frequencies in said first signal by said first amount, whereby said one of said phase shifted second signals is not phase shifted relative to said first signal whereas said other of said phase shifted second signals is phase shifted by ninety degrees relative to said first signal.

6. Apparatus comprising:

first and second input signal providing means;

processing means responsive to said first and second signals for providing a modified second signal, said processing means including for means providing a compensation signal corresponding to a selectable gain factor times the sum of said first and signals, plus a selectable gain factor times difference between said first and second signals, means for phase shifting at least a selected range of frequencies in said compensation signal by substantially ninety degrees relative to the same frequencies in said second signal and means for additively combining a signal corresponding at least generally to said second signal and said compensation signal so as to thereby form said modified second signal; and means for providing said first and modified second signals to individual channels of a plural channel communication system.

7. Apparatus as set forth in claim 6, wherein said means for providing said compensation signal comprises means for providing a sum signal corresponding to the sum of said first and second signals times a first selectable gain factor, means for providing a difference signal corresponding to the difference between said first and second signals times a second selectable gain factor, and means for additively combining said sum and difference signals to thereby provide said compensation signal.

8. Apparatus as set forth in claim 6, and further comprising filter means for high-pass filtering said compensation signal so that said compensation signal which is additively combined with said second signal effectively has lower frequencies removed therefrom.

9. Apparatus as set forth in claim 6, and further comprising means responsive to said first and second signals for providing a signal corresponding to the sum of said second signal and third and fourth signals, wherein said third signal corresponds to a third selectable gain factor times the sum of said first and second signals, and wherein said fourth signal corresponds to a fourth selectable gain factor times the difference between said first and second signals, and means for providing said signal corresponding to the sum of said second signal and said third and fourth signals to said additive combining means as said signal corresponding at least generally to said second signal.

10. Apparatus as set forth in claim 9, wherein said third and fourth selectable gain factors are frequency dependent.

11. Apparatus as set forth in claim 9, wherein said means for providing a signal corresponding to the sum of second, third and fourth signals comprises first and second functional blocks, each having two inputs A and B, an output and a transfer characteristic such that the output signal is substantially equal to the input signal applied to the B input plus a selectable gain factor times the difference between the two signals applied to inputs A and B, and means for providing said first and second signals to said A and B inputs, respectively, of said first functional block, and the additive inverse of said first signal and the signal on the output of said first functional block to the A and B inputs, respectively, of said second functional block, whereby said output of said second functional block corresponds to said sum of said second, third and fourth signals.

12. Apparatus as set forth in claim 11, wherein said selectable gain factors of each said functional block are frequency dependent.

13. Apparatus as set forth in claim 12, wherein each of said first and second functional blocks includes first gain adjustment means for selectably adjusting the low frequency gain of the functional block and second gain adjustment means for selectably adjusting the high frequency gain of the functional block.

14. Apparatus as set forth in claim 9, and further comprising switch means for switchably selecting one of at least two different values for each of said third and fourth selectable gain factors.

15. Apparatus as set forth in claim 6, and further comprising means for providing said first and second signals, said means including means for providing third and fourth signals, means for additively combining said third and fourth signals so as to thereby provide said first signal, and means for subtracting said third and fourth signals so as to thereby provide said second signal.

16. Apparatus as set forth in claim 6, and further comprising means for providing said first and second signals, said means including means for adding third and fourth signals so as to thereby provide a sum signal for use as said first signal, means for subtracting said third and fourth signals to provide a difference signals, and means for dynamically adjusting the gain of said difference signal so as to provide a gain-varying difference signal for use as said second signal.

17. Apparatus comprising:

means for providing a sum signal corresponding to the sum of first and second audio input signals and a difference signal corresponding to the difference between said first and second audio input signals, where the gain of said difference signal is dynamically varying, processing means responsive to said sum and difference signals for providing a modified difference signal corresponding generally to said difference signal but having a compensation signal combined therewith, said compensation signal corresponding to a selectable gain factor times the sum of said sum and difference signals, plus a selectable gain factor times the difference between said sum and difference signals; and, means for providing said sum and modified difference signals to a plural channel transmission system for transmission over independent channels thereof.

18. Apparatus as set forth in claim 17, wherein said processing means includes means for providing said compensation signal, means for phase shifting at least a selected range of frequencies in said compensation signal by a first amount relative to the same frequencies of said difference signal, and means for additively combining said phase shifted compensation signal and said difference signal so as to thereby form said modified difference signal.

19. Apparatus as set forth in claim 18, wherein said first amount by which said compensation signal is phase shifted is substantially ninety degrees.

20. Apparatus as set forth in claim 17, wherein said processing means includes first and second functional blocks, each having two inputs A and B, an output, and a transfer characteristic such that the output signal is substantially equal to the signal applied to the B input plus a selectable gain factor times the difference between the two signals applied to inputs A and B, and means for providing said sum and difference signals to the A and B inputs, respectively, of said first functional block, and the additive inverse of said sum signal and the output signal of said first functional block to the A and B inputs, respectively, of said second functional block, whereby the output signal provided by said second functional block corresponds to said modified difference signal.

21. Apparatus as set forth in claim 20, and further comprising means for providing a second compensation signal, means for phase shifting at least selected frequencies of said second compensation by a first amount relative to the same frequencies of said modified difference signal, and means for combining said second compensation signal with said modified difference signal so as to thereby provide a second modified difference signal for provision to said plural channel transmission system in place of said modified difference signal.

22. Apparatus as set forth in claim 21, wherein said first amount by which said second compensation signal is phase shifted relative to said modified difference signal is substantially ninety degrees.

23. Apparatus as set forth in claim 21, wherein said means for providing said second compensation signal comprises means for providing a second compensation signal corresponding generally to a selectable gain factor times said difference signal.

24. Apparatus as set forth in claim 21, wherein said means for providing said second compensation signal comprises means for providing a second compensation signal corresponding generally to the sum of third and fourth signals, said third signal corresponding to a selectable gain factor times the sum of said sum and difference signals, and said fourth signal corresponding to a selectable gain factor times the difference between said sum and difference signals.

25. In an AM stereo radio broadcasting system including left (L) and right (R) audio signal sources which provide audio signals to be modulated onto an RF carrier signal for transmission to a remote radio receiver, a matrix circuit to which said left and right audio signal sources are connected for adding and subtracting said signals to provide sum (L+R) and difference (L−R) signals, and an RF modulator and transmitter for modulating said sum and difference signals onto an RF carrier and for transmitting the resulting modulated RF carrier signal, the improvement comprising:

means for providing another difference signal which is phase shifted by a first fixed amount relative to the first difference signal over at least a range of frequencies;

means for adding the two difference signals together so as to provide a phase adjusted difference signal for provision to the RF modulator and transmitter in place of the first difference signal, wherein at least the frequencies of said phase adjusted signal which are in said range of frequencies are phase shifted with respect to the first difference signal by an amount dependent upon the relative proportions in which the two difference signals are added together, and means for selectively adjusting the relative proportions in which the two difference signals are added together so as to thereby selectively adjust the phase of said phase adjusted difference signal.

26. The improvement as set forth in claim 25, wherein said range of frequencies is the higher frequencies in said another difference signal and further comprising means for high pass filtering said another difference signal before it is added to the first difference signal.

27. The improvement as set forth in claim 25, and further comprising gain adjusting means for selectively and independently adjusting the gains of the left and right signals appearing in the first difference signal.

28. The improvement as set forth in claim 27, wherein said gain adjusting means includes means for selecting different gain factors for difference frequencies of said left and right signals appearing in the first difference signal.

29. In a stereo AM radio broadcasting system including left (L) and right (R) audio signal sources which provide audio signals to be modulated onto an RF carrier signal for transmission to a remote radio receiver, a matrix circuit to which said left and right audio signal sources are connected for adding and subtracting said signals to provide sum (L+R) and difference (L−R) signals, dynamic gain varying means responsive to the difference signal for dynamically varying its gain to provide a varying gain difference signal, and a quadrature AM transmitter for modulating the sum and varying-gain difference signals onto the in-phase and quadrature-phase carrier components, respectively, of a quadrature AM signal, the improvement comprising processing means responsive to said sum and varying gain difference signals for deriving a modified varying gain difference signal therefrom for application to the quadrature AM transmitter in place of said varying gain difference signal, said modified signal corresponding generally to said varying gain difference signal but also including a first selective gain component corresponding to the sum of said sum signal and said varying gain difference signal and a second selective gain component corresponding to the difference between said sum signal and said varying gain difference signal.

30. The improvement as set forth in claim 29, wherein said processing means includes means for phase shifting at least a selected range of frequencies in said first and second selective gain components relative to said gain varying difference signal by a first fixed amount.

31. The improvement as set forth in claim 30, wherein said first fixed amount is substantially ninety degrees.

32. The improvement as set forth in claim 29, wherein said processing means includes first and second functional blocks each having A and B inputs and an output and a transfer characteristic such that the output signal corresponds to the sum of the B input signal and a selectable gain factor times the sum of the A and B input signals, and means for providing said sum signal and said varying gain difference signal to said A and B inputs, respectively, of said first functional block, and for providing the additive inverse of said sum signal and said output of said first functional block to said A and B inputs, respectively, of said second functional block, whereby the output signal provided by said second functional block is said modified varying gain difference signal.

33. The improvement as set forth in claim 32, wherein selectable gain factors of said first and second functional blocks are frequency dependent.

* * * * *

UNITED STATES PATENT AND TRADEMARK OFFICE

CERTIFICATE OF CORRECTION

PATENT NO. : 4,451,927
DATED : May 29, 1984
INVENTOR(S) : David L. Hershberger

It is certified that error appears in the above-identified patent and that said Letters Patent are hereby corrected as shown below:

Column 14, line 57, change "including for means" to - - including means for - -.

Column 14, line 59, insert - - second - - after "and".

Column 14, line 60, insert - - the - - before "difference".

Signed and Sealed this

*Sixteenth* Day of *October 1984*

[SEAL]

*Attest:*

GERALD J. MOSSINGHOFF

*Attesting Officer*

*Commissioner of Patents and Trademarks*